US008815182B2

(12) United States Patent
Smit et al.

(10) Patent No.: US 8,815,182 B2
(45) Date of Patent: Aug. 26, 2014

(54) APPARATUS AND METHOD FOR HOLDING A CONTACT LENS DURING IN VITRO TESTING

(75) Inventors: Deon Smit, Cary, NC (US); Jeffrey Kuhn, Durham, NC (US); Jeremy Fetvedt, Raleigh, NC (US)

(73) Assignee: Agilent Technologies, Inc., Santa Clara, CA (US)

( * ) Notice: Subject to any disclaimer, the term of this patent is extended or adjusted under 35 U.S.C. 154(b) by 966 days.

(21) Appl. No.: 12/938,562

(22) Filed: Nov. 3, 2010

(65) Prior Publication Data

US 2012/0102721 A1 May 3, 2012

(51) Int. Cl.
*B01L 9/00* (2006.01)
*B01L 3/00* (2006.01)

(52) U.S. Cl.
CPC ..... *B01L 3/508* (2013.01); *B01L 2300/0609* (2013.01); *B01L 2300/047* (2013.01)
USPC ..... 422/560; 422/135; 422/561; 366/273; 366/274

(58) Field of Classification Search
USPC ..... 422/130, 135, 560, 561, 566; 366/241, 366/242, 273, 274; 436/176, 180
See application file for complete search history.

(56) References Cited

U.S. PATENT DOCUMENTS

| | | | | |
|---|---|---|---|---|
| 3,801,280 | A | 4/1974 | Shah et al. | |
| 4,759,635 | A | 7/1988 | MacMichael et al. | |
| 5,011,662 | A | 4/1991 | Noormohammadi et al. | |
| 5,215,717 | A | 6/1993 | Conant et al. | |
| 5,267,791 | A | 12/1993 | Christian et al. | |
| 5,412,979 | A | 5/1995 | Fassihi | |
| 5,540,496 | A | 7/1996 | Beckett et al. | |
| 6,126,904 | A | 10/2000 | Zuellig et al. | |
| 6,582,116 | B2 | 6/2003 | Nielsen | |
| 6,692,708 | B2 | 2/2004 | Chandler, Jr. | |
| 7,074,364 | B2 | 7/2006 | Jahn et al. | |
| 7,407,631 | B2 | 8/2008 | Swon et al. | |
| 2008/0190221 | A1 * | 8/2008 | Pegram et al. | 73/864.84 |

OTHER PUBLICATIONS

United States Pharmacopoeia, vol. 24, Ch. 711, pp. 1941-1944 & Ch. 724, pp. 1941-1951 (1998).
Varian 400-DS Automated Apparatus 7 Operator's Manual, P/N 70-9051, Revision A, 101 pgs (May 2007).

* cited by examiner

*Primary Examiner* — Jill Warden
*Assistant Examiner* — Dwayne K Handy
(74) *Attorney, Agent, or Firm* — Milstein Zhang & Wu LLC

(57) ABSTRACT

An apparatus for holding a contact lens during in vitro testing includes a first support member, a second support member, an alignment rod, and a cage member. The first support member includes a first end cap and a body portion. The body portion includes grooves formed in a lateral surface extending from the first end cap. The alignment rod is configured for interconnecting the body portion and a second end cap of the second support member. The cage member is positionable about the body portion between the first and second end caps, and includes an inner surface, an outer surface, and a plurality of openings between the inner surface and the outer surface. The inner surface and the lateral surface cooperatively define an annular space therebetween and a plurality of fluid flow paths between the inner space and the openings. The annular space is configured for receiving the contact lens.

19 Claims, 6 Drawing Sheets

APPARATUS AND METHOD FOR HOLDING A CONTACT LENS DURING IN VITRO TESTING

FIELD OF THE INVENTION

The present invention relates generally to in vitro testing of optical contact lenses. More particularly, the present invention relates to apparatus and methods for holding contact lenses during in vitro testing.

BACKGROUND OF THE INVENTION

Increasingly, research is being focused on drug-eluting optical contact lenses as a means for effective delivery of various ophthalmic medications, such as antibiotics. These drug-eluting contact lenses may include one or more thin coatings of a given drug, for example. The primary focus of such research is achieving sustained, controlled delivery of a given drug at the normal physiological temperature, pH and salinity of the human eye.

In vitro testing methods such as dissolution testing are useful for simulating the conditions under which a substance such as a pharmaceutical formulation is released under controlled conditions into a physiological environment, such as a gastrointestinal or vascular environment. The release of a sample formulation into appropriate media such as by dissolution facilitates the acquisition of optical signals or other data from which concentration, release rate or other information can be derived for prediction of or correlation with actual in vivo conditions. Some techniques entail agitation of the sample in media such as by stirring, rotation, or reciprocation.

To ensure validation of the data generated from dissolution-related procedures, dissolution testing is often carried out according to guidelines approved or specified by certain entities such as the United States Pharmacopoeia (USP), in which case the testing must be conducted within various parametric ranges. The parameters may include dissolution media temperature, the amount of allowable evaporation-related loss, and the use, position and speed of agitation devices, sample retention and/or holding devices, and other instruments operating in the test vessel.

For example, Chapters 711 (Dissolution) and 724 (Extended Release) of the USP guidelines describe the use of several techniques for performing agitation in test vessels containing a dissolution medium that is usually temperature-regulated. One of these techniques involves the use of a reciprocating holder (Apparatus 7). In Apparatus 7, various types of sample holders are attached to shafts and vertically reciprocated in vessels at a prescribed dip rate for the testing of dosage forms such as tablets and transdermal patches. However, conventional testing methods are not specifically designed for holding, supporting and testing newer types of pharmaceutical delivery means such as contact lenses. Without an effective holding apparatus, a contact lens may become deformed during in vitro testing. As a result, the resolution of data such as release rate data acquired during testing may not be optimized since the surfaces of the deformed contact lens may not adequately contact the dissolution medium during reciprocation, for example.

In view of the foregoing, there is a need for providing apparatus and methods specifically designed for effectively holding contact lenses during in vitro testing. In particular, there is a need for providing a contact lens holder that aids in maintaining a form or shape of the contact lens that is suitable for testing. In addition, there is a need for providing a contact lens holder that facilitates the free interchange (i.e., the proper distribution) of dissolution media within the holder so as to provide sufficient contact with the drug-containing surfaces of the contact lens.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an apparatus for holding a contact lens during in vitro testing includes a first support member, a second support member, an alignment rod, and a cage member. The first support member includes a first end cap and a body portion. The body portion includes a lateral surface extending from the first end cap in an axial direction, and a groove formed in the lateral surface extending along at least a portion of the length of the body portion. The second support member includes a second end cap. The second end cap is axially aligned with the body portion. The alignment rod is configured for interconnecting the second end cap and the body portion. The cage member includes an inner surface, an outer surface, and a plurality of openings between the inner surface and the outer surface. The cage member is positionable coaxially about the body portion between and in contact with the first end cap and the second end cap. The inner surface and the lateral surface cooperatively define an annular space therebetween and a plurality of fluid flow paths between the annular space and the openings The annular space is configured for receiving a contact lens.

In some implementations, the first and second end caps may include respective first and second surfaces for contacting opposing ends of the cage member, and the first and second surfaces may be tapered for providing contact with cage members of different dimensions.

In some implementations, the contact lens may be positioned within the annular space and at least partially surround the body portion.

In some implementations, the apparatus may include a locking member configured for engaging the second support member. The locking member may be alterable between a locked position and an unlocked position. In the unlocked position, the second support member may be axially adjustable along at least a portion of the length of the alignment rod for varying the space between the first and second support members. In the locked position, the second support member may be held in an axial position between the cage member and the locking member.

In some implementations, the alignment rod may pass through axially aligned respective bores in the locking member, the second support member and the body portion.

In some implementations, the locking member may include a compressible portion configured for securing the locking member to the alignment rod when the locking member is in the locked position.

In some implementations, the apparatus may include a drivable component configured to be disposed in a fixed relation to the cage member, wherein the drivable component may include a magnet for magnetically coupling with a driving source.

According to another implementation, an apparatus for effecting movement of a contact lens in a container during in vitro testing includes a contact lens holder and a drivable component. The contact lens holder is configured for holding a contact lens in a container during movement of the contact lens holder in the container. The contact lens holder may include one or more of the features or elements recited above, including an alignment rod. The drivable component may be attached to the alignment rod, and may include a magnet for magnetically coupling to a driving source disposed entirely outside the container. In response to the driving source, the drivable component and the contact lens holder may move together in the container.

In some implementations, the driving source may include a movable platform supporting external magnets. The platform may be configured for moving along at least a portion of the length of the container.

According to another implementation, a method is provided for holding a contact lens during in vitro testing. A cage member may be positioned coaxially about a body portion of a first support member, such that a first end of the cage member is in contact with a first end cap of the first support member. A second end cap of a second support member may be placed in contact with a second end of the cage member. An alignment rod may be positioned through axially aligned respective alignment bores in the second end cap and the body portion. A contact lens is positioned within an annular space defined by an inner surface of the cage member and a lateral surface of the body portion.

In some implementations, the second support member may be locked in an axial position by engaging a locking member to the second support member.

In some implementations, the cage member includes the inner surface, an outer surface, and a plurality of openings between the inner surface and the outer surface, and the inner surface and the lateral surface cooperatively define a plurality of fluid flow paths between the annular space and the openings.

In some implementations, dissolution media may be flowed through the openings of the cage member, through the annular space, and into contact with the contact lens while moving the cage member through a container containing the dissolution media.

In some implementations, the body portion includes grooves formed in the lateral surface and extending along at least a portion of the length of the body portion.

According to another implementation, a method is provided for performing dissolution testing on a contact lens. A contact lens may be loaded into a holding device such that the contact lens is constrained to movement within an annular space bounded by the holding device. Dissolution media may be flowed into contact with the contact lens by moving the holding device through a container containing the dissolution media, wherein the dissolution media flows through a plurality of openings of the holding device and into the annular space, and a releasable component initially retained on the contact lens is released into the dissolution media.

In some implementations, a liquid sample may be removed from the container. The liquid sample may include dissolution media and a quantity of the releasable component.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

Figure 1:
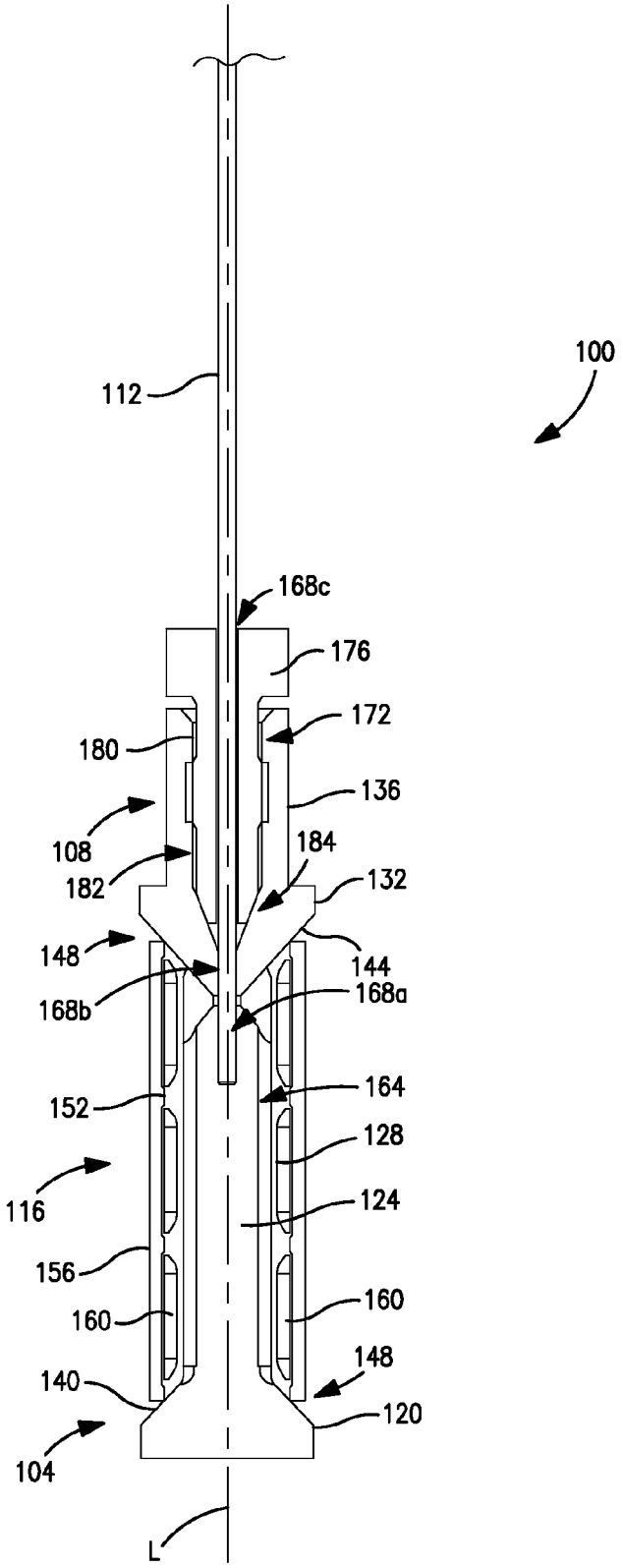
FIG. 1 is a cross-sectional elevation view of an example of a contact lens holder configured for holding a contact lens during in vitro testing according to an implementation disclosed herein.

In the context of the present disclosure, the term "contact lens" generally encompasses any optical lens (e.g., soft, rigid and/or hybrid rigid/soft lenses) configured for positioning on or otherwise in contact with the human or animal eye for therapeutic, cosmetic, corrective, or other purposes. A contact lens may generally include a convex surface and a concave surface configured for contacting an eye. Generally, a wide variety of contact lenses are known to those skilled in the art.

In the context of the present disclosure, the convex surface and/or the concave surface of the contact lens may include a releasable quantity of material that can provide a sample in conjunction with dissolution testing or other types of testing. The releasable quantity of material may include analytes of interest, for example, a therapeutically active agent such as a pharmaceutical drug, chemical, biochemical, or biologically active material intended for in vivo delivery in a human or animal via the eye. The releasable material may be soluble, elutible, suspendable, or diffusible in a suitable medium, or mixable with a medium, or otherwise combinable with or transportable to a medium to facilitate analysis of one or more components of the releasable material by any desired means. The contact lens may include any suitable releasable material delivery mechanism. For example, the convex surface and/or the concave surface of the contact lens may be coated with or may otherwise carry a releasable material that can be released from the contact lens at a controlled rate via elution, diffusion, or other mechanism of transport. Non-limiting examples of releasable material delivery mechanisms in the context of the present disclosure include microspheres, gels, ointments, oils and/or creams that may be present on the convex and/or concave surface of the contact lens in the form of thin films, coatings, layers, and the like. In addition, the releasable material (or releasable component) may include one or more non-active materials used as fillers, excipients, carriers or retainers of the active agent, binding agents, coloring agents, tagging or marking agents, preservatives, buffers, means for controlling the release rate of the active material, or a combination of two or more of these functions, and/or for other purposes.

As used herein, the term "medium" or "media" generally encompasses a solvent such as water, alcohol, and/or any other medium into which the releasable material can be released, as well as any additives or reagents. The medium may be buffered at a desired pH level or otherwise formulated to emulate a physiological environment such as the ocular environment. For example, in the context of the present disclosure, the medium may be formulated to emulate the salinity of biological fluid present on the surface of the human eye. The term "medium" or "media" may also include materials released from the contact lens, for example a therapeutically active agent, excipient, release rate modifier, and the like. Thus, the term "medium" or "media" may encompass a multi-component combination or matrix such as may be produced in a test vessel, including a solution, suspension, emulsion, particulate-laden mixture, colloidal mixture, or the like.

Examples of embodiments or implementations of the subject matter disclosed herein will now be described in more detail with reference to FIGS. 1-7.

FIG. 1 is a cross-sectional elevation view of an example of an apparatus 100 for holding a contact lens during in vitro testing according to an implementation of the present teachings (also referred to herein as the "contact lens holder 100" or the "contact lens holding apparatus 100"). The contact lens holding apparatus 100 may be used in conjunction with an in vitro testing apparatus, such as a dissolution testing apparatus (see FIG. 7). For example, the contact lens holding apparatus 100 may be used in conjunction with the 400-DS Automated Dissolution Apparatus 7, which is commercially available from Varian, Inc., now a part of Agilent Technologies, Inc., Santa Clara, Calif. The contact lens holding apparatus 100 may be employed to effectively hold the contact lens (not shown) during in vitro testing so as to facilitate the release of releasable materials such as therapeutically active agents from the contact lens into a suitable medium. The contact lens holding apparatus 100 may be utilized in preparation for or in conjunction with measuring a property or quality relating to the performance of the contact lens or of the releasable material, such as the rate at which the releasable material is released from the contact lens over a designated time period.

The contact lens holding apparatus 100 generally includes a first support member 104, a second support member 108, an alignment rod 112, and a cage member 116. The first support member 104 may include a first end cap 120 and a first body portion 124. The first body portion 124 may include a lateral surface 128 extending from the first end cap 120 in an axial direction (along a longitudinal axis designated L in FIG. 1). The second support member 108 may include a second end cap 132 and a second body portion 136. The second body portion 136 may extend from the second end cap 132 in the axial direction. As illustrated in FIG. 1, the cage member 116 may be positioned coaxially about the first body portion 124 between and in contact with the first end cap 120 and the second end cap 132. The first end cap 120 and the second end cap 132 include respective first and second inward-facing surfaces 140, 144 (i.e., surfaces that face each other and slant in towards the longitudinal axis L) against which opposite ends 148 of the cage member 116 respectively contact or abut. In some implementations, the first and second inward-facing surfaces 140, 144 are each generally cone-shaped or otherwise angled or tapered relative to the longitudinal axis L of the contact lens holding apparatus 100 to accommodate cage members 116 of different dimensions.

The cage member 116 generally extends along the longitudinal axis L and may include an inner surface 152, an outer surface 156 and a plurality of openings 160 between the inner surface 152 and the outer surface 156. The openings 160 may be disposed about the longitudinal axis L, at a transverse (i.e., radial) distance from the longitudinal axis L. The inner surface 152 and the lateral surface 128 cooperatively define an annular space (see FIG. 6, where the annular space is generally designated 604) therebetween and a plurality of fluid flow paths between the annular space and the openings 160. The annular space is configured for receiving the contact lens (see FIGS. 2 and 6). As will be described in further detail below, the contact lens may be positioned within the annular space and may at least partially surround the first body portion 124. In general, the contact lens may be rolled or otherwise positioned within the annular space such that a concave surface of the contact lens faces the lateral surface 128 of the first body portion 124, and a convex surface of the contact lens faces the inner surface 152 of the cage member 116. The first body portion 124 aids in maintaining the form of the contact lens; i.e., the first body portion 124 helps minimize instances in which the contact lens collapses or otherwise deforms during in vitro testing. When the contact lens is positioned within the annular space, and the contact lens holding apparatus 100 is used in conjunction with a dissolution testing apparatus for example, the openings 160 in the cage member 116 allow for free interchange of media between the openings 160 and the annular space such that media may freely contact all portions of the convex surface and/or all portions of the concave surface of the contact lens. The openings 160 are not limited in shape to that illustrated in FIG. 1, as the openings 160 may be any suitable shape, such as circular, ovular, or elliptical, as non-limiting examples. Although described herein as the cage member 116, in other implementations, the element 116 may comprise a basket, disk, netting, cell, cylinder or the like for adequately containing the contact lens during reciprocation through media, for example.

As further illustrated in FIG. 1, the first body portion 124 may include grooves or channels 164 formed in the lateral surface 128 and extending along at least a portion of the length of the first body portion 124. As may be seen in further detail in FIG. 2, when grooves 164 are formed in the lateral surface 128, a ridge is present between each adjacent groove 164. As used herein, the phrase "grooves 164 formed in the lateral surface 128" is intended to interchangeably refer to and encompass implementations in which ridges are added to a lateral surface, thereby forming grooves between adjacent ridges. The grooves 164 in the first body portion 124 function to increase the annular space available for fluid flow during in vitro testing. For example, when the contact lens is positioned within the annular space, and the contact lens holding apparatus 100 is used in conjunction with a dissolution testing apparatus, the concave surface of the contact lens may adhere to or otherwise contact the lateral surface 128 of the first body portion 124. In this example, the grooves 164 provide increased annular space available for the free flow of media between the openings 160 in the cage member 116 and the lateral surface 128 (i.e., within the grooves 164) such that the media may freely contact the concave surface of the contact lens.

The first and second support members 104, 108 may be axially aligned with each other and interconnected via the alignment rod 112. As shown in FIG. 1, in some implementations the alignment rod 112 may interconnect the second end cap 132 and the first body portion 124, wherein the second end cap 132 is axially aligned with the first body portion 124. The second end cap 132 may be axially aligned with the first body portion 124 at an axial distance from the first body portion 124, wherein the axial distance may be dependent upon the length of the cage member 116. The first and second support members 104, 108 may include axially aligned respective alignment bores 168*a*, 168*b* through which the alignment rod 112 may pass or extend. As shown in FIG. 1, the alignment bore 168*a* in the first support member 104 may only extend through a portion of the length of the first body portion 124. In other implementations, the alignment bore 168*a* may extend into or all of the way through the first end cap 120. The alignment rod 112 may be removably attached to the first support member 104. The removable attachment may be accomplished by any means, such as by providing external threads on the alignment rod 112 for engaging internal threads formed in the alignment bore 168*a*. As an alternative, for example, the alignment rod 112 may be removably secured within the alignment bore 168*a* by press-fitting. In some implementations, once the alignment rod 112 is secured within the alignment bore 168*a*, the first support member 104 may be fixed in its axial position relative to the length of the alignment rod 112.

As further illustrated in FIG. 1, the second support member 108 may include an inner space 172 configured for receiving a locking member 176. The locking member 176 may be secured within the inner space 172 by any suitable means. For example, the locking member 176 may include an externally threaded portion for engaging with threads formed on an internal wall 180 of the second support member 108. As shown in FIG. 1, the internal wall 180 may transition from a section 182 that is substantially parallel with the longitudinal axis L, to a tapered section 184 (i.e., the tapered section 184 is inward-facing or slanted towards the longitudinal axis L). The tapered section 184 may transition to the alignment bore 168*b* in the second support member 108 through which the alignment rod 112 may pass. The alignment rod 112 may pass through axially aligned respective alignment bores 168*c*, 168*b* and 168*a* in the locking member 176, the second support member 108, and the first body portion 124. As shown in greater detail in FIG. 3, the locking member 176 may include a compressible portion (generally designated 304 in FIG. 3) such as a collar configured for securing the locking member 176 to the alignment rod 112. For example, as the locking member 176 is screwed, threaded, or otherwise secured within the inner space 172, the compressible portion may contact the tapered section 184 of the internal wall 180, thus forcing the compressible portion to compress around the alignment rod 112. As the compressible portion compresses around the alignment rod 112, the locking member 176 locks the second support member 108 in its axial position relative to the length of the alignment rod 112. Accordingly, the locking member 176 may be alterable between a locked position and an unlocked position. In the unlocked position, the second support member 108 (along with the locking member 176) may be axially adjustable along at least a portion of the length of the alignment rod 112 for varying the space between the first and second support members 104, 108. In the locked position, the second support member 108 may be held in its axial position relative to the length of the alignment rod 112 (e.g., its axial position between the cage member 116 and the locking member 176. The locking member 176 may be altered from the locked position to the unlocked position by, for example, unscrewing the locking member 176 from the threads present on the internal wall 180. As the locking member 176 is unscrewed, the compressible portion decompresses from around the alignment rod 112; i.e., the compressible portion moves out of contact with the tapered section 184.

As discussed further below in conjunction with FIG. 4, the contact lens holding apparatus 100 may include a drivable component (not shown), wherein the drivable component comprises a magnet for magnetically coupling with a driving source (see FIG. 7). The magnet may be positioned within a housing, and the housing may be configured for coupling to the alignment rod 112 at an axial distance from the second support member 108. In response to the driving source, the contact lens holding apparatus 100 may reciprocate or otherwise move during in vitro testing, such as dissolution testing.

Figure 2:
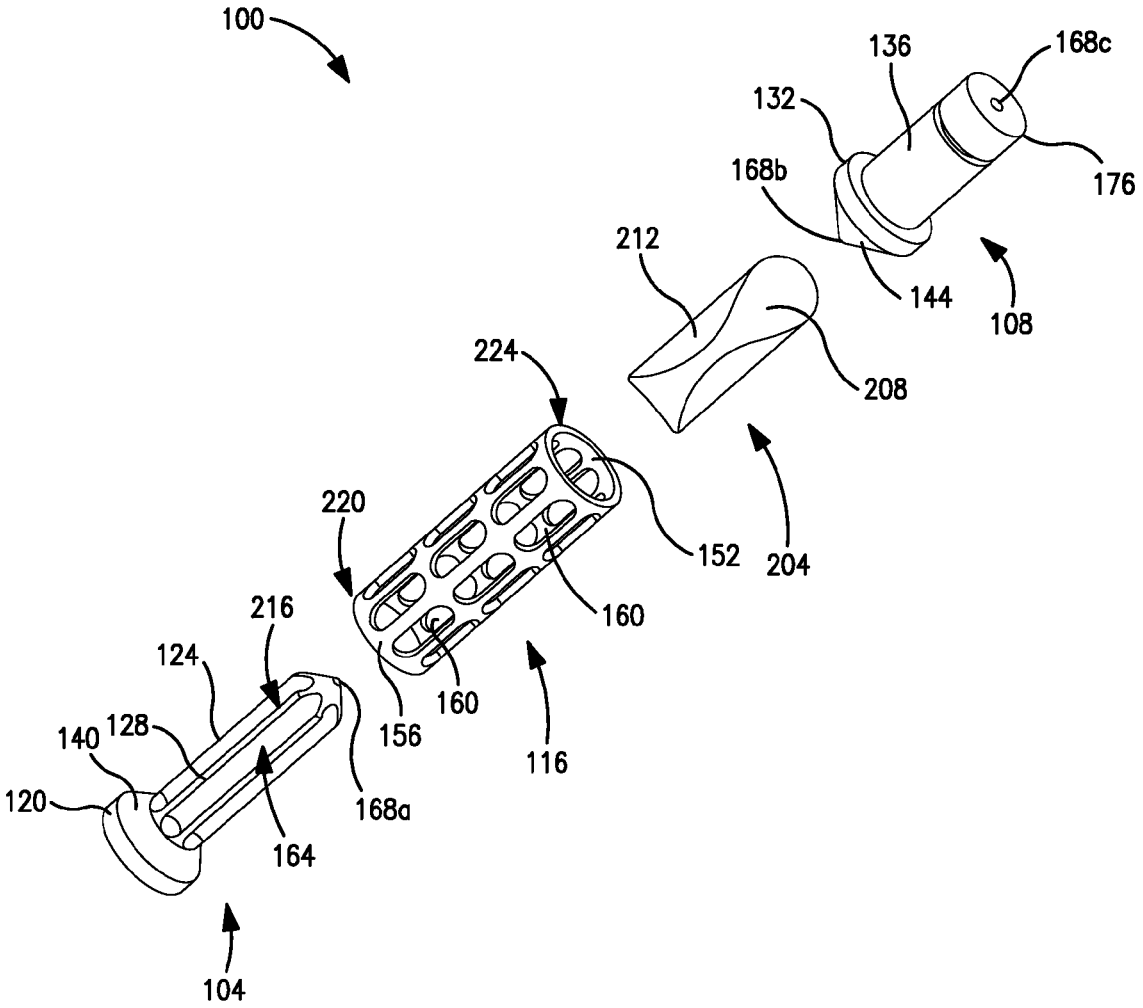
FIG. 2 is an exploded view of the contact lens holder illustrated in FIG. 1, and further illustrating a contact lens to be held during in vitro testing.
Figure 3:
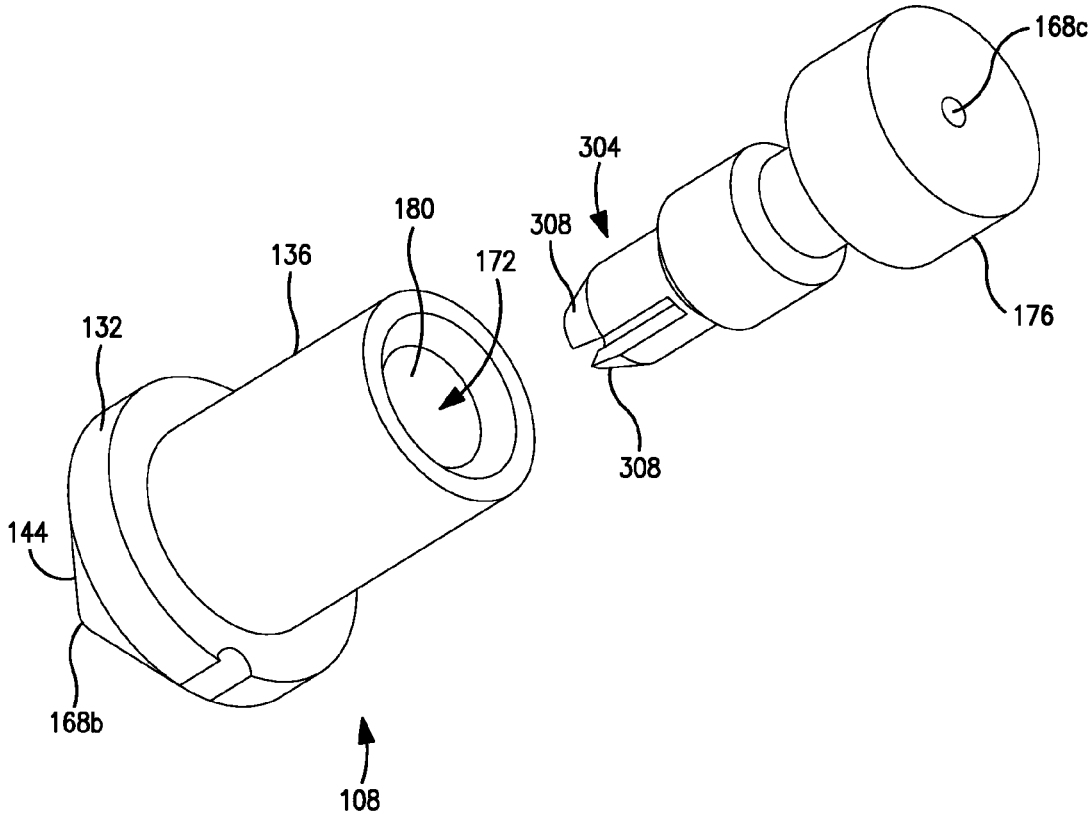
FIG. 3 is an exploded view of an example of a support member and a locking member that may be included with the contact lens holder illustrated in FIGS. 1-2.

The contact lens holding apparatus 100 may be assembled as discussed below in conjunction with FIGS. 2 and 3. FIG. 2 is an exploded view of the contact lens holding apparatus 100 illustrated in FIG. 1, shown without the alignment rod (element 112 in FIG. 1), and further illustrating a contact lens 204 to be held by the apparatus 100 during in vitro testing. The contact lens 204 typically includes a concave surface 208 and a convex surface 212 as noted above. FIG. 3 illustrates an exploded view of the second support member 108 and the locking member 176. It will be understood that assembling the contact lens holding apparatus 100 is not limited to the order of steps presented below.

The cage member 116 may be positioned coaxially about the first body portion 124, in which case a first end 220 of the cage member 116 may contact the first surface 140 of the first end cap 120. As shown in FIG. 2, the cage member 116 may be generally cylindrical in shape, although in other implementations the cage member 116 may have a non-cylindrical shape (e.g., an elliptical or polygonal cross-section). The contact lens 204 may be positioned within the annular space (see element 604, FIG. 6) defined by the inner surface 152 of the cage member 116 and the lateral surface 128 of the first body portion 124. The contact lens 204 may be rolled or otherwise formed such that when the contact lens 204 is positioned within the annular space, the concave surface 208 of the contact lens 204 faces (with or without contact with) the lateral surface 128, and the convex surface 212 of the contact lens 204 faces (with or without contact with) the inner surface 152 of the cage member 116. As discussed above in conjunction with FIG. 1, the cage member 116 may include a plurality of openings 160 between the inner surface 152 and the outer surface 156. When the cage member 116 is positioned coaxially about the first body portion 124, a plurality of fluid flow paths are formed between the annular space and the openings 160. For example, the openings 160 can allow for free interchange of media between the openings 160 and the annular space such that media may freely contact the convex surface 212 during dissolution testing. As shown in FIG. 2, the first body portion 124 may include grooves or channels 164 formed in the lateral surface 128 and extending along at least a portion of the length of the first body portion 124, wherein the grooves 164 may be separated by adjacent ridges 216. The grooves 164 provide increased annular space available for fluid flow during in vitro testing. For example, the concave surface 208 may adhere to or otherwise contact the lateral surface 128 during dissolution testing. The grooves 164 provide flow paths from the openings 160 and/or the annular space for allowing the dissolution media to freely contact the concave surface 208.

The second end cap 132 may be positioned such that the second inward-facing surface 144 is in contact with a second end 224 of the cage member 116. As discussed above, the first and second surfaces 140, 144 may be tapered for providing contact with cage members 116 of different dimensions; i.e., different diameters. The cage member 116 is secured between the first support member 104 and the second support member 108 by altering the locking member 176 to the locked position. That is, the locking member 176 may be threadably secured to the internal wall 180 such that the compressible portion (see element 304 in FIG. 3) compresses around the alignment rod 112 (FIG. 1) and locks the second support 108 member in its axial position. As discussed in conjunction with FIG. 1, the alignment rod 112 may be passed through the axially aligned respective alignment bores 168*c*, 168*b* and 168*a* in the locking member 176, the second support member 108 and the first body portion 124. The alignment rod 112 may be threadably secured within the alignment bore 168*a* of the first body portion 124. As shown in FIG. 3, the compressible portion 304 or collar may include clamping elements 308 configured for compressibly surrounding the alignment rod 112 as the compressible portion 304 comes into contact with the tapered section 184 of the internal wall 180.

To disassemble the contact lens holding apparatus 100, the locking member 176 may be altered to the unlocked position, in which case the second support member 108 is axially adjustable relative to the length of the alignment rod 112 and/or relative to the first support member 104. This adjustability or variability in spacing between the first and second support members 104, 108 is advantageous in that the apparatus 100 may accommodate cage members 116 of various axial dimensions. This adjustability is also advantageous in that the user may desire to adjust or remove the second support member 108 from the alignment rod 112 during loading or unloading of the contact lens 204, instead of disassembling all of the components of the apparatus 100. The removability of the second support member 108 from the alignment rod 112 also facilitates cleaning or replacement of the individual components of the apparatus 100.

Figure 4:
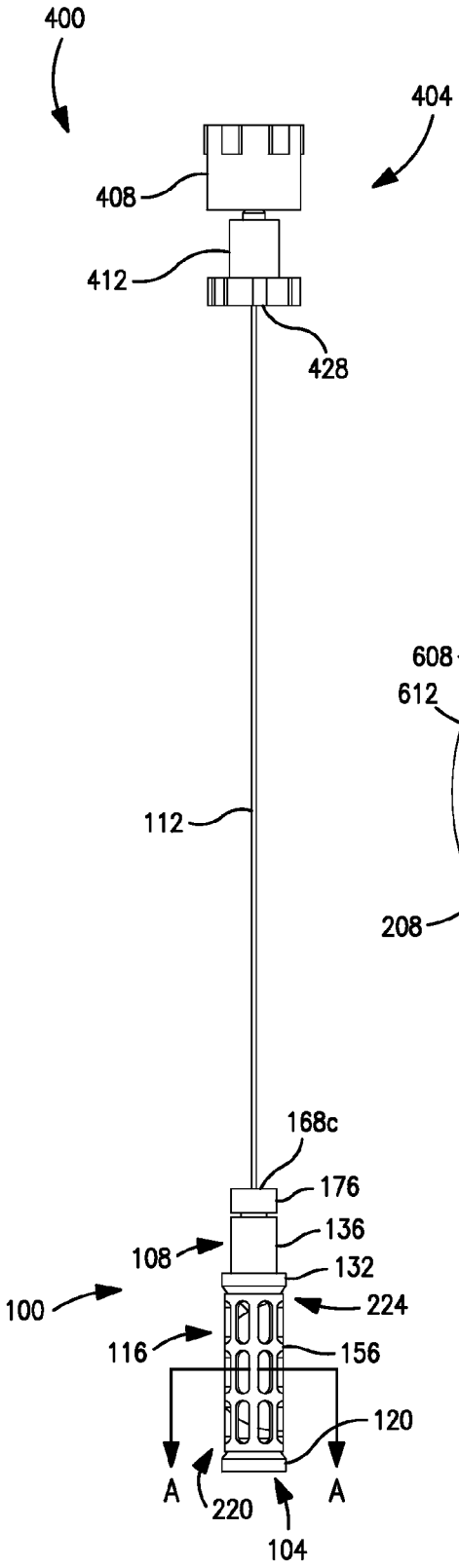
FIG. 4 is an elevation view of an example of an apparatus for effecting movement of a contact lens during in vitro testing, comprising the contact lens holder illustrated in FIGS. 1-2 and a drivable component attached to an alignment rod of the contact lens holder.

FIG. 4 is an elevation view of an example of an apparatus 400 for effecting movement of the contact lens (element 204 in FIGS. 2 and 6) during in vitro testing. The apparatus 400 may include the contact lens holder 100 discussed above in conjunction with FIGS. 1-3, and a drivable component 404 attached to or forming a part of the contact lens holder 100. In some implementations, the apparatus 400 may be characterized as a contact lens holder 100 that includes the additional feature of the drivable component 404. The drivable component 404 may be attached to the alignment rod 112 at an axial distance from the second support member 108. During in vitro testing, such as dissolution testing, the apparatus 400 may be positioned within a container, such as a dissolution testing vessel (see FIG. 7). In response to a driving source disposed entirely outside the container (i.e., a "non-contact" driving source), the drivable component 404 and the contact lens holder 100 move together in the container. It can be appreciated that the apparatus 400 may be employed not only in conjunction with the non-contact driving source (see FIG. 7) such as described herein, but also in conjunction with a driving source having a direct mechanical linkage with the drivable component 404. Thus the present disclosure encompasses embodiments and methods in which the apparatus 400 is driven with or without the non-contact driving source. For example, the contact lens holder 100 may be adapted for direct mechanical reference to an alignment rod that is physically coupled to a motorized drivable component.

The drivable component 404 may be any structure capable of being driven to reciprocate and/or otherwise move within the container without physically contacting or engaging the driving source. One advantage of providing the non-contact driving source is that the driving source can operate externally relative to the container, thus enabling the container to be fully sealed using a lid, septum, or the like, and substantially preventing evaporation or other material loss during in vitro testing. The drivable component 404 discussed herein includes an internal magnet (see element 504 in FIG. 5) disposed within a housing 408. The internal magnet can be secured to or integrated with the apparatus 400 by any means that enables the contact lens holder 100 to be reciprocated or otherwise moved with the internal magnet in response to the driving source. In the example illustrated in FIG. 4, the housing 408 is attached to the alignment rod 112 via a coupling member 412. In some implementations, the internal magnet may be located at the second support member 108 or at the locking member 176. For example, the internal magnet may be attached to (or integrally formed with) the second support member 108 or the locking member 176.

Figure 5:
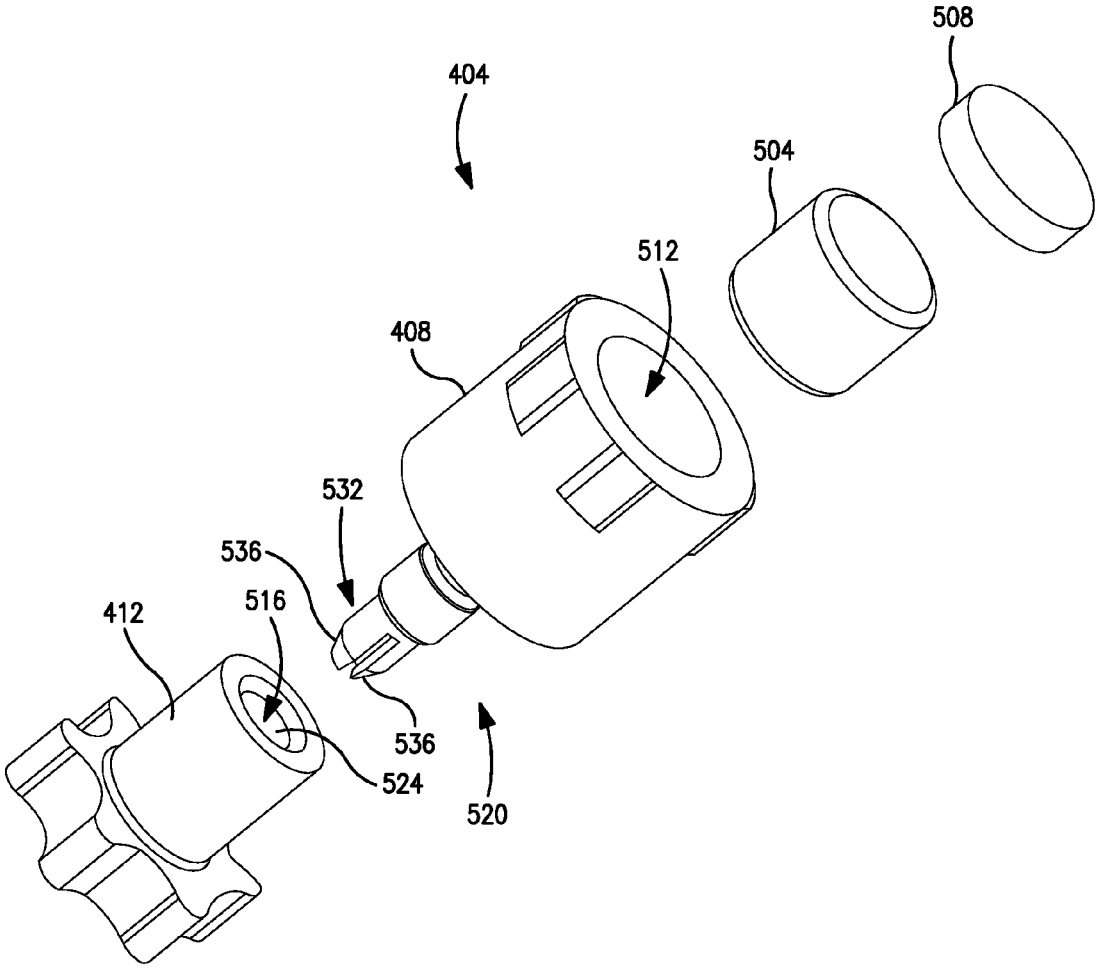
FIG. 5 is an exploded view of an example of the drivable component illustrated in FIG. 4.

FIG. 5 is an exploded view of the drivable component 404 illustrated in FIG. 4, and is but one example embodiment of the housing 408 and the coupling member 412. In FIG. 5, a top portion 508 of the housing 408 is removed from the housing 408 for illustrative purposes. The internal magnet 504 may be positioned within an inner chamber 512 of the housing 408. In the present example, the internal magnet 504 is cylindrically shaped, but it will be understood that the internal magnet 504 may be any one of a variety of shapes, so long as the inner chamber 512 is configured complementarily, such that the internal magnet 504 may be positioned within the inner chamber 512. In some implementations the top portion 508 may be removably secured to the housing 408. For example, the top portion 508 may include external threads for mating with internal threads within the inner chamber 512. In other implementations, the top portion 508 may be press fitted into the inner chamber 512 to secure the internal magnet 504 within the housing 408.

In some implementations, the housing 408 and the coupling member 412 may be configured similar to the locking member 176 and the first support member 104 (FIG. 1), respectively. The coupling member 412 may include an inner space 516 configured for receiving an axial extension 520 from the housing 408. The axial extension 520 may include an externally threaded portion for engaging with threads formed on an internal wall 524 of the coupling member 412. The internal wall 524 may transition from a section (not shown) that is substantially parallel with the longitudinal axis, to a tapered section (not shown); i.e., the tapered section is inward-facing or slanted towards the longitudinal axis. The tapered section of the internal wall 524 may transition to an alignment bore (see element 428 in FIG. 4) in the coupling member 412 through which the alignment rod 112 may pass. The alignment rod 112 may pass through axially aligned respective alignment bores 428, 168*c*, 168*b* and 168*a* in the coupling member 412, the locking member 176, the second support member 108 and the first body portion 124. Similar to the locking member 176, the axial extension 520 may include a compressible portion 532 such as a collar configured for securing the housing 508 (and accordingly the internal magnet 504 within the housing 408) to the alignment rod 112. The compressible portion 432 may include clamping elements 536 for compressing around the alignment rod 112 as the compressible portion 432 comes in contact with the tapered section of the internal wall 524. Various other features discussed above in conjunction with the locking member 176 and the second body portion 136 may similarly be employed in conjunction with the housing 408 and the coupling member 412, respectively.

Figure 6:
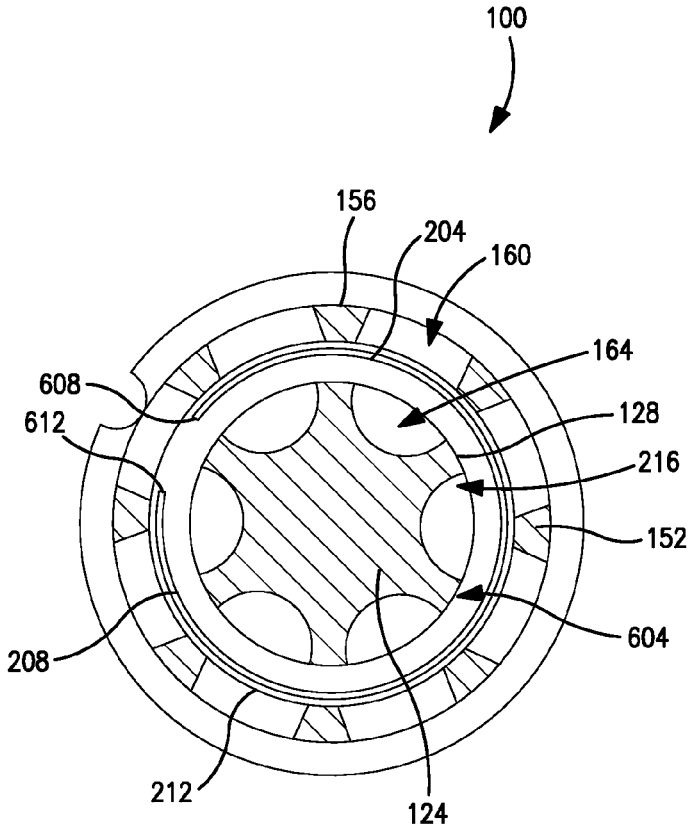
FIG. 6 is a cross-sectional view of the contact lens holder illustrated in FIG. 4, taken along line A-A of FIG. 4.

FIG. 6 is a cross-sectional view of the contact lens holder 100, taken along line A-A in FIG. 5. The contact lens 204 is positioned within the annular space 604 and partially surrounds the first body portion 124. As shown, the first body portion 124 may be sized such that the contact lens 204 may be rolled or otherwise positioned within the annular space 604 without any overlap of edge portions 608 and 612 of the contact lens 204. This aids in optimizing the surface area of the contact lens 204 available for contact with media or other fluid during in vitro testing. In addition, and as previously discussed, grooves 164 may be formed in the lateral surface 128 to aid in optimizing fluid contact with the concave surface 208 of the contact lens 204 during in vitro testing. Fluid flow paths are present between the annular space 604 and the openings 160 of the cage member 116. For example, during dissolution testing, media may flow through the openings 160, into the annular space 604 (including the grooves 164, if provided), and into contact with the convex surface 212 and/or the concave surface 208 of the contact lens 204.

Figure 7:
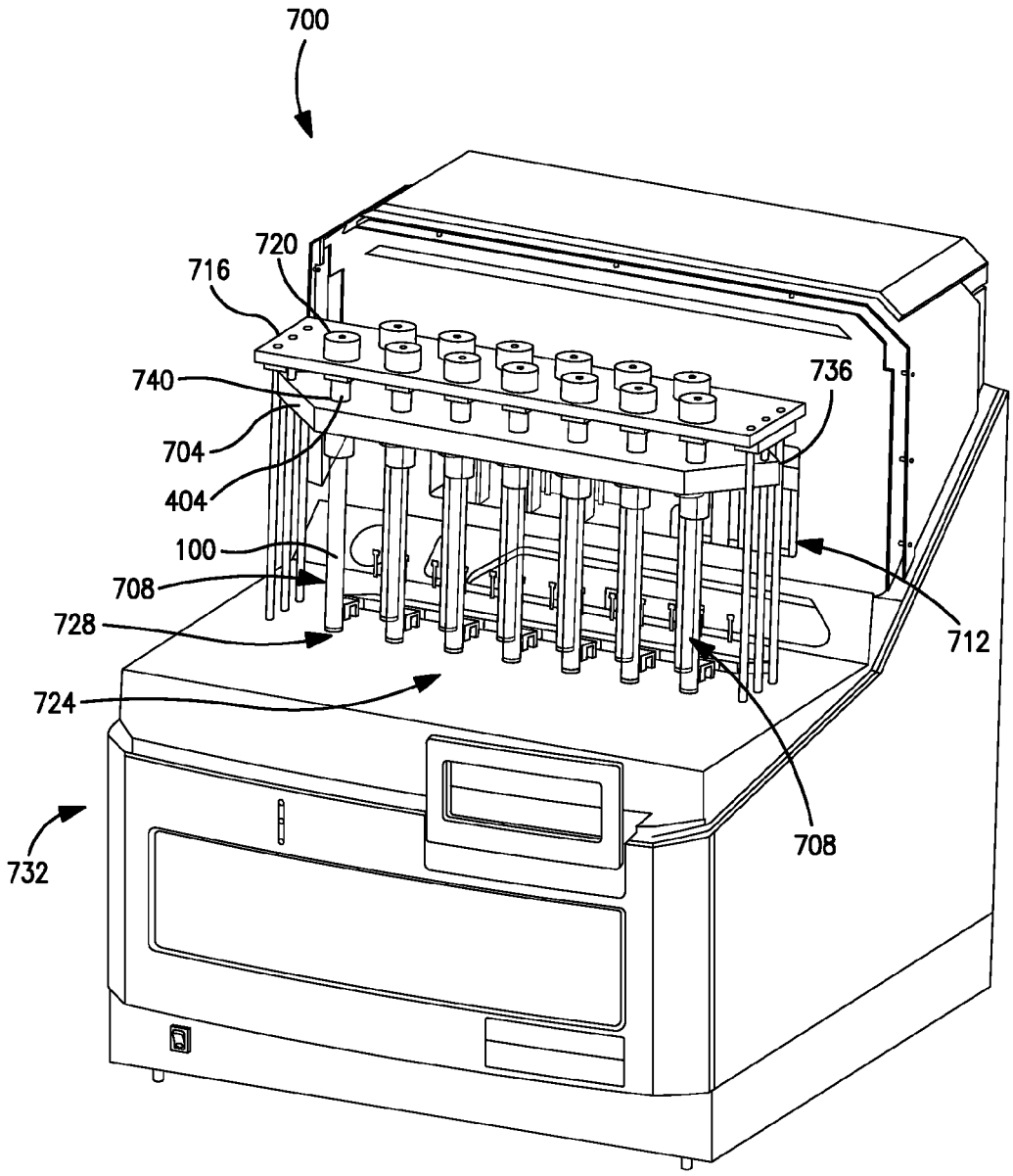
FIG. 7 is a perspective view of an example of an in vitro dissolution testing apparatus including a contact lens holder, a drivable component, and a driving source.

FIG. 7 is a perspective view of an example of an in vitro dissolution testing apparatus 700 including the contact lens holder 100, the drivable component 404, and the non-contact driving source 704. As mentioned previously, the dissolution testing apparatus 700 may, for example, be provided as (or may generally be similar to) the 400-DS Automated Dissolution Apparatus 7 available from Varian, Inc., Santa Clara, Calif. An apparatus for holding and effecting movement of a contact lens, such as the apparatus 400 described above and illustrated in FIG. 4, may be utilized with or form a part of the testing apparatus 700. In the testing apparatus 700, several testing procedures may be respectively performed in a plurality of test vessel units 708 operating simultaneously, for example. In some implementations, the testing apparatus 700 may include a vessel support assembly 712. The vessel support assembly 712 may include any structure suitable for defining an array of test sites at which one or more test vessel units 708 may be located—preferably in a consistent, repeatable manner—and which may be compatible with the use of the drive source 704 and one or more contact lens holders 100 and corresponding drivable components 404 as described above. For example, the vessel support assembly 712 may include a top vessel plate 716 having apertures through which test vessel units 716 can be extended. The top vessel plate 716 may also support closure members 720 for substantially isolating the contents of each test vessel unit 708 from the ambient environment. The vessel support assembly 712 may also include a base portion 724 for supporting the bottom of each test vessel unit 708 mounted in the vessel support assembly 712. The base portion 724 may also include a sampling port 728 located at the bottom of each test vessel unit 708 for automated sampling from each test vessel unit 708. Each sampling port 728 may fluidly communicate with sampling vials (not shown) located within a housing 732. As may be appreciated by those skilled in the art, each test vessel unit 708 may include a heating jacket for controlling the temperature of the media in each test vessel unit 708. Those of skill in the art will also appreciate that the testing apparatus 700 may be controlled by a personal computer or other electronic processor-based hardware (with software as appropriate) in communication with corresponding circuitry within the testing apparatus 700. The dissolution testing apparatus 700 may include a variety of other features known to those skilled in the art.

As discussed previously, the drivable component 404 and the contact lens holder 100 may be positioned entirely within the test vessel unit 708. The driving source 704 may be disposed entirely outside the test vessel unit 708 and in magnetic communication with the internal magnet 504 (see FIG. 5). In response to operation of the driving source 704, the drivable component 404 and the contact lens holder 100 may move together (i.e., reciprocate) in the test vessel unit 708. As shown in FIG. 7, the driving source 704 may comprise a movable platform 736 located between the top vessel plate 716 and the base portion 724. The platform 736 is movable by any suitable arrangement of components known to those skilled in the art, such as rods and/or pistons in mechanical communication with the movable platform 736. The movable platform 736 may support external magnets 740 (i.e., external to the test vessel units 708) that magnetically couple to the internal magnets 504 in the drivable components 404. The external magnets 740 are configured for establishing a magnetic field pattern suitable for maintaining an attraction between the external magnets 740 and the internal magnets 504 of the drivable components 404 across the thickness of the wall of the test vessel unit 708. As appreciated by those skilled in the art, the external magnets 740 are configured for magnetically coupling with the internal magnets 504 of the drivable components 404 to a degree that enables the drivable components 404 to move in response to movement of the driving source 704, while preventing the drivable components 404 from being decoupled and allowing the drivable components 404 and the contact lens holders 100 to drop to the bottom of the test vessel units 708. The platform 736 is configured for moving along at least a portion of the length of each test vessel unit 708. The test vessel units 708 may extend through bores in the platform 736. As the platform 736 reciprocates between the top vessel plate 716 and the base portion 724, the drivable component 404 and the contact lens holder 100 reciprocate together within the test vessel unit 708.

As described herein, the movement of the drivable component 404 and the contact lens holder 100 can constitute a linear reciprocation along the longitudinal axis of the test vessel unit 708. However, it will be understood that in other implementations, the drivable component 404 and the contact lens holder 100 may rotate about the longitudinal axis of the test vessel unit 708. For example, the driving source 704 may be configured such that the external magnets 740 are rotated about the longitudinal axis of the test vessel unit 708 to cause the internal magnet 504 of each drivable component 404 to rotate by means of the resulting changes in orientation of the magnetic field. The rotation can be in one direction through repeating full (360-degree) cycles or can be in alternating directions (e.g., clockwise/counterclockwise) through partial cycles.

In any of the of the implementations described herein in which magnets are employed to enable movement by non-contacting actuation, it will be understood that the magnets may include permanent magnets, electromagnets, or both. Accordingly, terms such as "magnet," "magnetic," and "magnetic coupling" as used throughout this disclosure encompass the use of a permanent magnet and/or an electromagnet. Stated alternatively, the term "magnet" as used herein may be a material that exhibits magnetization due to its possessing a permanent magnetic dipole or in response to an external field or application of electrical current. For instance, external magnets 740 coupled to the movable platform 736 may be provided as electromagnets to enable selective magnetic coupling with the internal magnets 504. In implementations in which an electromagnet is provided, it will be appreciated by persons skilled in the art that the electromagnet may be placed in communication with a suitable electrical current or voltage source through electrical leads, and may entail the use of coils, solenoids, or the like to produce a magnetic field of sufficient strength to control, for example, the drivable component 404.

From the foregoing descriptions, it will be understood that various methods are intended to be within the scope of the present disclosure, including, but not limited to: methods for holding the contact lens 204 during in vitro testing; methods for assembling and disassembling the contact lens holding apparatus 100 and methods for preparing the contact lens 204 for dissolution testing, in which case the contact lens 204 may be held by the contact lens holding apparatus 100 and coupled to the drivable component 404.

As may be seen from the present disclosure, the contact lens holding apparatus 100 provides and an effective means for holding the contact lens 204 during in vitro testing, such as dissolution testing. The contact lens holder 100 provides a plurality of fluid flow paths for the free interchange of media into and out of the holder 100, thus allowing contact between the media and the convex and/or concave surfaces 212, 208 of the contact lens 204 during testing. In addition, the contact lens holder 100 aids in maintaining the form of the contact lens 204 during testing, thus facilitating reliable test results.

In general, terms such as "communicate" and "in communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An apparatus for holding a contact lens during in vitro testing, the apparatus comprising:

a first support member comprising a first end cap and a body portion, the body portion comprising a lateral surface extending from the first end cap in an axial direction, and a groove formed in the lateral surface extending along at least a portion of the length of the body portion;

a second support member comprising a second end cap comprising an inner space;

an alignment rod configured for interconnecting the second end cap and the body portion, wherein the second end cap is axially aligned with the body portion;

a locking member configured to be receptive by the inner space of the second support member; and a cage member comprising an inner surface, an outer surface, and a plurality of openings between the inner surface and the outer surface, wherein the cage member is positionable coaxially about the body portion between and in contact with the first end cap and the second end cap, the inner surface and the lateral surface cooperatively define an annular space therebetween and a plurality of fluid flow paths between the annular space and the openings, and the annular space is configured for receiving a contact lens.

2. The apparatus of claim 1, herein the locking member is alterable between a locked position and an unlocked position, and wherein:

in the unlocked position, the second support member is axially adjustable along at least a portion of the length of the alignment rod for varying the space between the first and second support members; and in the locked position, the second support member is held in an axial position between the cage member and the locking member.

3. The apparatus of claim 2, wherein the first and second end caps comprise respective first and second surfaces for contacting opposing ends of the cage member, and the first and second surfaces are tapered relative to the axial direction.

4. The apparatus of claim 3, further comprising the contact lens positioned within the annular space and at least partially surrounding the body portion.

5. The apparatus of claim 2, wherein the alignment rod passes through axially aligned respective alignment bores in the locking member, the second support member and the body portion.

6. The apparatus of claim 5, wherein the locking member comprises a compressible portion configured for securing the locking member to the alignment rod when the locking member is in the locked position.

7. The apparatus of claim 2, further comprising a drivable component configured to be disposed in a fixed relation to the cage member, wherein the drivable component comprises a magnet for magnetically coupling with a driving source.

8. The apparatus of claim 7, wherein the drivable component comprises a housing configured for coupling to the alignment rod, and wherein the magnet is positioned within the housing.

9. An apparatus for effecting movement of a contact lens in a container during in vitro testing, the apparatus comprising:

a contact lens holder comprising:

a first support member comprising a first end cap and a body portion, the body portion comprising a lateral surface extending from the first end cap in an axial direction, and a groove formed in the lateral surface extending along at least a portion of the length of the body portion;

a second support member comprising a second end cap axially aligned with the body portion;

a locking member configured to be receptive by an inner space of the second support member;

a cage member comprising an inner surface, an outer surface, and a plurality of openings between the inner surface and the outer surface, wherein the cage member is positionable coaxially about the body portion between and in contact with the first end cap and the second end cap, the inner surface and the lateral surface cooperatively define an annular space therebetween and a plurality of fluid flow paths between the annular space and the openings, and the annular space is configured for receiving the contact lens; and an alignment rod passing through axially aligned respective alignment bores in the second support member and the first support member;

and a drivable component attached to the alignment rod, the drivable component comprising a magnet for magnetically coupling to a driving source disposed entirely outside the container, wherein in response to the driving source, the drivable component and the contact lens holder move together in the container.

10. The apparatus of claim 9, wherein the locking member is alterable between a locked position and an unlocked position, and wherein:

in the unlocked position, the second support member is axially adjustable along at least a portion of the length of the alignment rod for varying the space between the first and second support members; and in the locked position, the second support member is held in its axial position between the cage member and the locking member.

11. The apparatus of claim 10, further comprising the driving source, wherein the driving source comprises a movable platform supporting external magnets, wherein the platform is configured for moving along at least a portion of the length of the container.

12. The apparatus of claim 11, wherein the first and second end caps comprise respective first and second surfaces for contacting opposing ends of the cage member, and the first and second surfaces are tapered relative to the axial direction.

13. The apparatus of claim 12, wherein the locking member includes a compressible portion configured for securing the locking member to the alignment rod when the locking member is in the locked position.

14. A method for holding a contact lens during in vitro testing, comprising:

positioning a cage member coaxially about a body portion of a first support member, wherein a first end of the cage member is in contact with a first end cap of the first support member;

positioning a contact lens within an annular space defined by an inner surface of the cage member and a lateral surface of the body portion;

placing a second end cap of a second support member in contact with a second end of the cage member;

positioning an alignment rod through axially aligned respective alignment bores in the second end cap and the body portion; and locking the second support member in a fixed axial position by securing a locking member within an inner space of the second support member, wherein the body portion comprising a lateral surface extending from the first end cap in an axial direction and a groove formed in the lateral surface extending along at least a portion of the length of the body portion.

15. The method of claim 14, wherein the cage member comprises the inner surface, an outer surface and a plurality of openings between the inner surface and the outer surface, and the inner surface and the lateral surface cooperatively define a plurality of fluid flow paths between the annular space and the openings.

16. The method of claim 15, further comprising flowing dissolution media through the openings of the cage member, through the annular space, and into contact with the contact lens while moving the cage member through a container containing the dissolution media.

17. The method of claim 16, wherein the body portion comprises grooves formed in the lateral surface extending along at least a portion of the length of the body portion.

18. The method of claim 14, wherein the cage member, first support member, second support member and alignment rod form a holding device, and further comprising flowing dissolution media into contact with the contact lens by moving the holding device through a container containing the dissolution media, wherein the dissolution media flows through a plurality of openings of the cage member and into the annular space, and a releasable component initially retained on the contact lens is released into the dissolution media.

19. The method of claim 18, further comprising removing a liquid sample from the container, the liquid sample comprising dissolution media and the releasable component.

* * * * *

UNITED STATES PATENT AND TRADEMARK OFFICE

CERTIFICATE OF CORRECTION

PATENT NO. : 8,815,182 B2
APPLICATION NO. : 12/938562
DATED : August 26, 2014
INVENTOR(S) : Deon Smit et al.

It is certified that error appears in the above-identified patent and that said Letters Patent is hereby corrected as shown below:

In the Claims

In column 13, line 54, In Claim 2, delete "herein" and insert -- wherein --, therefor.

In column 15, line 5, In Claim 13, delete "claim 12," and insert -- claim 10, --, therefor.

Signed and Sealed this
Ninth Day of December, 2014

Michelle K. Lee

Michelle K. Lee
*Deputy Director of the United States Patent and Trademark Office*